US007165326B2

(12) United States Patent
Kurihara et al.

(10) Patent No.: US 7,165,326 B2
(45) Date of Patent: Jan. 23, 2007

(54) HEAT EXCHANGER AND PROCESS FOR FABRICATING SAME

(75) Inventors: Akio Kurihara, Oyama (JP); Shigeo Marugasa, Oyama (JP)

(73) Assignee: Showa Denko K.K., Tokyo (JP)

( * ) Notice: Subject to any disclaimer, the term of this patent is extended or adjusted under 35 U.S.C. 154(b) by 148 days.

(21) Appl. No.: 10/498,017

(22) PCT Filed: Dec. 16, 2002

(86) PCT No.: PCT/JP02/13119

§ 371 (c)(1),
(2), (4) Date: Jun. 16, 2004

(87) PCT Pub. No.: WO03/052338

PCT Pub. Date: Jun. 26, 2003

(65) Prior Publication Data

US 2005/0061492 A1 Mar. 24, 2005

Related U.S. Application Data

(60) Provisional application No. 60/356,117, filed on Feb. 14, 2002.

(30) Foreign Application Priority Data

Dec. 17, 2001 (JP) ..... 2001-382905

(51) Int. Cl.
*B23P 15/26* (2006.01)
*F28D 1/047* (2006.01)

(52) U.S. Cl. ..... 29/890.047; 165/150; 165/179

(58) Field of Classification Search ..... 165/150; 29/890.047

See application file for complete search history.

(56) References Cited

U.S. PATENT DOCUMENTS 5,303,565 A * 4/1994 Pravda ..... 62/476

(Continued)

FOREIGN PATENT DOCUMENTS

JP 46068/1978 4/1978

(Continued)

*Primary Examiner*—Leonard R. Leo
(74) *Attorney, Agent, or Firm*—Oblon, Spivak, McClelland, Maier & Neustadt, P.C.

(57) ABSTRACT

A heat exchanger for use as an evaporator, for example, in refrigerators wherein a hydrocarbon refrigerant is used. The heat exchanger comprises a finned zigzag tube 1 comprising a zigzag tube member 2 formed by bending a pipe having no welded seams, the zigzag tube member 2 having at least three straight tube portions 2*a* arranged from the front rearward at a spacing and parallel to one another, a plurality of first fin groups 3 arranged at a spacing on two adjacent straight tube portions 2*a* of the zigzag tube member 2 longitudinally of the straight tube portions and each comprising plate fins 5 extending across and fixedly arranged in parallel on the adjacent straight tube portions 2*a*, and a plurality of second fin groups 4 each comprising plate fins 6 fixedly arranged in parallel on each remaining straight tube portion 2*a* of the zigzag tube member 2, the second fin groups 4 being arranged at a spacing on the remaining straight tube portion 2*a* longitudinally thereof so as to be in the same positions as the respective first fin groups 3 with respect to the longitudinally direction of the straight tube portions 2*a*. The heat exchanger E comprising the finned zigzag tube 1 exhibits the desired refrigeration performance with the leakage of refrigerant diminished.

20 Claims, 7 Drawing Sheets

U.S. PATENT DOCUMENTS 5,692,560 A * 12/1997 Messant et al. ..... 165/151
6,253,839 B1 * 7/2001 Reagen et al. ..... 165/151

FOREIGN PATENT DOCUMENTS

JP 4-37428 2/1992
JP 04073598 A * 3/1992
JP 4-279234 10/1992
JP 06331294 A * 11/1994
JP 9-253775 9/1997
JP 2000-249479 9/2000
JP 2000-304484 11/2000
JP 2001124485 A * 5/2001

* cited by examiner

HEAT EXCHANGER AND PROCESS FOR FABRICATING SAME

CROSS REFERENCE TO RELATED APPLICATIONS

This application is an application filed under 35 U.S.C. §111(a) claiming the benefit pursuant to 35 U.S.C. §119(e)(1) of the filing date of Provisional Application No. 60/356,117 filed Feb. 14, 2002 pursuant to 35 U.S.C. §111(b).

TECHNICAL FIELD

The present invention relates to heat exchangers, for example, for use as evaporators in refrigeration devices such as refrigerators or refrigerated showcases, and to a process for fabricating the heat exchanger.

The direction indicated by the arrow X in FIGS. 3 and 7 will be referred to as "front," and the opposite direction as "rear." FIGS. 1, 4 and 5 are also based on the same front-rear relation. The upper and lower sides of the drawings will be referred to as "upper" and "lower," respectively, and the left- and right-hand sides of FIGS. 1, 3, 4 and 7 as "left" and "right," respectively.

BACKGROUND ART

FIG. 7 shows an evaporator conventionally used in refrigeration devices such as refrigerators or refrigerated showcases. With reference to FIG. 7, the conventional evaporator 30 comprises two fin groups 32 arranged one above the other at a spacing and each comprising a plurality of plate fins 31 arranged in parallel from left to right, a plurality of straight tubes 33 arranged at a spacing from the front rearward and extending through all the plate fins 31 of the upper and lower fin groups 32, and a plurality of bends 34 interconnecting the respective pairs of adjacent straight tubs 33 so as to pass a refrigerant through all the straight tubes 33 one after another.

The evaporator 30 is fabricated by the following process. First prepared are a plurality of straight tubes 33, plate fins 31 each having holes, and a tube enlarging device comprising a wire and a tube enlarging ball attached to one end of the wire. All the straight tubes 33 are then inserted through the respective holes of each plate fin 31. The wire of the tube enlarging device is thereafter inserted through each tube from one end thereof and pulled at the other end to force the ball through the tube 33 to enlarge the tube 33 and fixedly fit all the plate fins 31 around the tube. The ends of the straight tubes 33 are then welded to opposite ends of U-shaped bends 34 to thereby interconnect all the straight tubes 33 by the bends 34. In this way, the evaporator 30 is fabricated.

Studies are recently under way for the use of hydrocarbon refrigerants which are less likely to destroy the ozone layer and to influence global warming, in refrigerators, refrigerated showcases and like refrigeration devices as substitutes for chlorofluorocarbon refrigerants. Since the hydrocarbon refrigerants are flammable, there is a need to minimize the leakage of the refrigerant.

With the conventional evaporator 30 described above, however, the straight tubes 33 are welded to the U-shaped bends 34, so that the refrigerant is likely to leak from the welded joints.

Accordingly, it is thought that this problem can be overcome by an evaporator prepared from a finned hairpin tube which comprises a hairpin tube, and a plurality of fin groups arranged on the hairpin tube longitudinally thereof at a spacing and each comprising parallel plate fins extending across and fixed to the two straight tube portions of the hairpin tube, by bending the finned hairpin tube zigzag in its entirety at portions thereof having no fin groups.

This evaporator is fabricated by the process to be described below. First prepared are a hairpin tube, a multiplicity of plate fins each having two holes which are spaced apart, and a tube enlarging device comprising a pressure rod and an enlarging mandrel attached to one end of the rod. The two straight tube portions of the hairpin tube are then inserted through the respective holes of each plate fin to thereby arrange the plate fins in parallel into a plurality of unfixed fin groups as spaced apart on the tube portions longitudinally thereof. The mandrel of the tube enlarging device is subsequently forced into the straight tube portions from each open end of the hairpin tube to enlarge the tube portions and to fixedly fit the plate fins of each fin group around the tube portions of the hairpin tube, whereby a finned hairpin tube is produced. The finned hairpin tube is thereafter bent into a zigzag form in its entirety at portions thereof having no fin groups. In this way, the evaporator is fabricated.

The evaporator fabricated by this process has no joints formed in the hairpin tube of the finned hairpin tube, so that no leakage of the refrigerant occurs unlike the evaporator 30 shown in FIG. 7. However, the evaporator is less effective for achieving an improved refrigeration efficiency by an increase in heat transfer area since the plate fins are merely so sized as to extend across the two straight tube portions.

An object of the present invention is to overcome the foregoing problems and to provide a heat exchanger which is capable of exhibiting the desired refrigeration performance with the leakage of refrigerant diminished when used as an evaporator in refrigeration devices.

DISCLOSURE OF THE INVENTION

The present invention provides a heat exchanger comprising a zigzag tube formed by bending a pipe having no welded seams and having at least three straight tube portions arranged from the front rearward at a spacing and parallel to one another, and a plurality of plate fins fixedly fitted around the straight tube portions.

With the heat exchanger of the invention, the zigzag tube is prepared by bending a single pipe having no welded seams, so that the heat exchanger is usable free from the leakage of refrigerant as an evaporator in refrigeration devices. The heat exchanger is therefore adapted for use with a hydrocarbon refrigerant which is less likely to destroy the ozone layer and to influence global warming. Since the heat exchanger comprises a zigzag tube having at least three straight tube portions arranged in parallel to one another, and plate fins fixedly fitted around the straight tube portions, an increased number of plate fins can be provided in the exchanger to give an increased heat transfer area and achieve an improved heat exchange efficiency, e.g., an improved refrigeration efficiency when the exchanger is used as the evaporator of the refrigeration device.

The heat exchanger of the invention may comprise a first fin group comprising a plurality of plate fins extending across and fixedly arranged in parallel on two adjacent straight tube portions of the zigzag tube, and a second fin group comprising a plurality of plate fins fixedly arranged in parallel on each remaining straight tube portion of the zigzag tube. This provides an increased number of fin plates in the heat exchanger, giving an increased heat transfer area to achieve an improved heat exchange efficiency, e.g., an improved refrigeration efficiency when the exchanger is used as an evaporator in refrigeration devices.

With the heat exchanger of the invention, the zigzag tube may be integrally provided on an inner peripheral surface thereof with inner fins extending longitudinally thereof and arranged at a spacing circumferentially thereof. The heat exchanger then exhibits improved heat exchange performance.

Each plate fin of the heat exchanger of the invention may be fixed to the straight tube portion of the zigzag tube by enlarging the tube with use of a fluid. Even if the zigzag tube in this case has inner fins projecting from the inner peripheral surface thereof to a relatively great height in order to afford an increased heat transfer area, the desired refrigeration performance (heat exchange performance) is available without the likelihood of the tube enlargement collapsing the inner fin.

With the heat exchanger of the invention, the zigzag tube may have high and low two kinds of inner fins alternately arranged circumferentially thereof and projecting from the inner peripheral surface of the tube to different heights, the high inner fins being 0.7 to 1.7 mm in height from the tube surface, the low inner fins being 0.4 to 1.2 mm in height from the surface. The heat exchanger then effectively improved in heat exchange performance.

With the heat exchanger of the invention wherein the zigzag tube has the high and low two kinds of inner fins, the pitch of the inner fins is 0.4 to 1.6 mm.

With the heat exchanger of the invention wherein the zigzag tube has the high and low two kinds of inner fins, the zigzag tube is 6 to 10 mm in outside diameter and 0.4 to 0.8 mm in the wall thickness of a circumferential wall thereof.

With the heat exchanger of the invention, all the inner fins are equal in height and are 0.7 to 1.2 mm in height from the inner peripheral surface of the zigzag tube. The heat exchanger then exhibits still improved heat exchange performance.

With the heat exchanger of the invention wherein all the inner fins are equal in height, the pitch of the inner fins may be 0.4 to 1.6 mm.

With the heat exchanger of the invention wherein all the inner fins are equal in height, the zigzag tube may be 6 to 10 mm in outside diameter and 0.4 to 0.8 mm in the wall thickness of a circumferential wall thereof.

With the heat exchanger of the invention, the front-to-rear length of the plate fins of the second fin group is approximately one half the front-to-rear length of the plate fins of the first fin group.

With the heat exchanger of the invention, the first fin group may be different from the second fin group in fin pitch. For example, the second fin group is greater than the first fin group in fin pitch.

The present invention provides another heat exchanger comprising a finned zigzag tube including a zigzag tube member formed by bending a pipe having no welded seams, the zigzag tube member having at least three straight tube portions arranged from the front rearward at a spacing and parallel to one another, a plurality of first fin groups arranged at a spacing on two adjacent straight tube portions of the zigzag tube member longitudinally of the straight tube portions and each comprising a plurality of plate fins extending across and fixedly arranged in parallel on the adjacent straight tube portions, and a plurality of second fin groups each comprising a plurality of plate fins fixedly arranged in parallel on each remaining straight tube portion of the zigzag tube member, the second fin groups being arranged at a spacing on the remaining straight tube portion longitudinally thereof so as to be in the same positions as the respective first fin groups with respect to the longitudinally direction of the straight tube portions, the finned zigzag tube being bent between the first fin groups and between the second fin groups on all the straight tube portions so as to position the first fin groups one above another and the second fin groups one above another in superposed layers, the spacing between the adjacent first fin groups and the spacing between the second fin groups being a length permitting bending of the straight tube portions of the finned zigzag tube.

With the second-mentioned heat exchanger of the invention, the zigzag tube is prepared by bending a single pipe having no welded seams, so that the heat exchanger is usable free from the leakage of refrigerant as an evaporator in refrigeration devices. The heat exchanger is therefore adapted for use with a hydrocarbon refrigerant which is less likely to destroy the ozone layer and to influence global warming. Since the heat exchanger comprises first fin groups each comprising a plurality of plate fins extending across and fixedly arranged in parallel on two adjacent straight tube portions of the zigzag tube member, and second fin groups each comprising plate fins fixedly arranged in parallel on each remaining straight tube portion of the zigzag tube member, an increased number of plate fins can be provided in the exchanger to give an increased heat transfer area and achieve an improved heat exchange efficiency, e.g., an improved refrigeration efficiency when the exchanger is used as the evaporator of the refrigeration device. Especially because the first fin groups, as well as the second fin groups, are arranged in at least two superposed stages, this arrangement affords an increased heat transfer area to achieve a further improved heat exchange efficiency, e.g., a greatly improved refrigeration efficiency when the exchanger is used as the evaporator of the refrigeration device.

With the second-mentioned heat exchanger of the invention, the zigzag tube member may be integrally provided on an inner peripheral surface thereof with inner fins extending longitudinally thereof and arranged at a spacing circumferentially thereof. The heat exchanger then exhibits improved heat exchange performance.

Each plate fin of the second-mentioned heat exchanger of the invention may be fixed to the straight tube portion of the zigzag tube member by enlarging the tube member with use of a fluid. Even if the zigzag tube member in this case has inner fins projecting from the inner peripheral surface thereof to a relatively great height in order to afford an increased heat transfer area, the desired refrigeration performance (heat exchange performance) is available without the likelihood of the tube member enlargement collapsing the inner fin.

With the second-mentioned heat exchanger of the invention, the zigzag tube member may have high and low two kinds of inner fins alternately arranged circumferentially thereof and projecting from the inner peripheral surface of the tube member to different heights, the high inner fins being 0.7 to 1.7 mm in height from the tube member surface, the low inner fins being 0.4 to 1.2 mm in height from the surface. The heat exchanger then effectively improved in heat exchange performance.

With the second-mentioned heat exchanger of the invention wherein the zigzag tube member has the high and low two kinds of inner fins on the inner peripheral surface thereof, the pitch of the inner fins is 0.4 to 1.6 mm.

With the second-mentioned heat exchanger of the invention wherein the zigzag tube member has the high and low two kinds of inner fins on the inner peripheral surface thereof, the zigzag tube member is 6 to 10 mm in outside diameter and 0.4 to 0.8 mm in the wall thickness of a circumferential wall thereof.

With the second-mentioned heat exchanger of the invention, all the inner fins are equal in height and are 0.7 to 1.2 mm in height from the inner peripheral surface of the zigzag tube member. The heat exchanger then exhibits still improved heat exchange performance.

With the second-mentioned heat exchanger of the invention wherein all the inner fins are equal in height, the pitch of the inner fins may be 0.4 to 1.6 mm.

With the second-mentioned heat exchanger of the invention wherein all the inner fins are equal in height, the zigzag tube member may be 6 to 10 mm in outside diameter and 0.4 to 0.8 mm in the wall thickness of a circumferential wall thereof.

With the second-mentioned heat exchanger of the invention, the front-to-rear length of the plate fins of the second fin groups is approximately one half the front-to-rear length of the plate fins of the first fin groups.

With the second-mentioned heat exchanger of the invention, the first fin groups may be different from the second fin groups in fin pitch. For example, the second fin groups are greater than the first fin groups in fin pitch.

The present invention provides a refrigeration device which has a refrigeration cycle having a compressor, a condenser and an evaporator, the evaporator being one of the heat exchangers described wherein a hydrocarbon refrigerant is used as the refrigerant and circulated at a rate of 1 to 9 kg/h.

The present invention provides a process for fabricating a heat exchanger, i.e., a heat exchanger according to claim 2, which process includes preparing a hairpin tube by bending a pipe having no welded seams and a multiplicity of plate fins each having two holes spaced apart in a forward or rearward direction, inserting two straight tube portions of the hairpin tube through the respective holes of all the plate fins to thereby arrange the plate fins in parallel into a predetermined number of unfixed fin groups spaced apart on the straight tube portions longitudinally thereof by a length permitting bending of the straight tube portions; enlarging the hairpin tube to fixedly position the plate fins across the two straight tube portions to obtain a finned hairpin tube having a dividable fin group for forming second fin groups and a first fin group; dividing the plate fins of the entire dividable fin group into portions fixed to one of the straight tube portions and portions fixed to the other straight tube portion to form the second fin groups and outwardly bending the two straight tube portions of the finned hairpin tube forward and rearward respectively.

The heat exchanger according to claim 2 and having the foregoing advantage can be fabricated by this process of the invention relatively easily.

The present invention provides a process for fabricating another heat exchanger, i.e. a heat exchanger according to claim 14, which process includes preparing a hairpin tube by bending a pipe having no welded seams and a multiplicity of plate fins each having two holes spaced apart in a forward or rearward direction, inserting two straight tube portions of the hairpin tube through the respective holes of all the plate fins to thereby arrange the plate fins in parallel into a predetermined number of unfixed fin groups spaced apart on the straight tube portions longitudinally thereof by a length permitting bending of the straight tube portions; the predetermined number being n (which is an integer of not smaller than 2) times the number, not smaller than 2, of unfixed fin groups positioned closer to a bent portion of the hairpin tube for forming first fin groups; enlarging the hairpin tube to fixedly position the plate fins across the two straight tube portions to obtain a finned hairpin tube having dividable fin groups for forming second fin groups and the first fin group; dividing the plate fins of all the dividable fin groups into portions fixed to one of the straight tube portions and portions fixed to the other straight tube portion to form the second fin groups and outwardly bending the two straight tube portions of the finned hairpin tube forward and rearward respectively.

The heat exchanger according to claim 14 and having the foregoing advantage can be fabricated by the second-mentioned process of the invention relatively easily.

In the process of the invention for fabricating either one of the two heat exchangers, the hairpin tube may be integrally provided on an inner peripheral surface thereof with inner fins extending longitudinally thereof and arranged at a spacing circumferentially thereof.

In the process of the invention for fabricating either one of the two heat exchangers, the hairpin tube may be enlarged with use of a fluid.

In the process of the invention for fabricating either one of the two heat exchangers, the hairpin tube may have high and low two kinds of inner fins alternately arranged circumferentially thereof and projecting from the inner peripheral surface of the tube to different heights, the high inner fins being 0.7 to 1.7 mm in height from the tube surface, the low inner fins being 0.4 to 1.2 mm in height from the surface.

In the process of the invention for fabricating either one of the two heat exchangers wherein the hairpin tube has the high and low two kinds of inner fins on the inner peripheral surface thereof, the pitch of the inner fins is 0.4 to 1.6 mm.

In the process of the invention for fabricating either one of the two heat exchangers wherein the hairpin tube has the high and low two kinds of inner fins on the inner peripheral surface thereof, the hairpin tube is 6 to 10 mm in outside diameter and 0.4 to 0.8 mm in the wall thickness of a circumferential wall thereof.

In the process of the invention for fabricating either one of the two heat exchangers, all the inner fins are equal in height and are 0.7 to 1.2 mm in height from the inner peripheral surface of the hairpin tube.

In the process of the invention for fabricating either one of the two heat exchangers wherein all the inner fins are equal in height, the pitch of the inner fins may be 0.4 to 1.6 mm.

In the process of the invention for fabricating either one of the two heat exchangers wherein all the inner fins are equal in height, the hairpin tube may be 6 to 10 mm in outside diameter and 0.4 to 0.8 mm in the wall thickness of a circumferential wall thereof.

In the process of the invention for fabricating either one of the two heat exchangers, the plate fins of the dividable fin group for forming the second fin groups may each comprise two fin forming portions and connecting portions dividably joining the two fin forming portions. The hairpin tube can then be inserted through the holes of the plate fins with greater ease, and the plate fins are dividable easily in the subsequent step.

In the process of the invention for fabricating either one of the two heat exchangers, the plate fins of the first fin group and the plate fins of the dividable fin group for forming the second fin groups may be identical in shape, and the plate fins of the dividable fin group may each have a V-shaped notch formed in a midportion of at least one of upper and lower edges thereof in the forward or rearward direction, and a slit extending upward or downward and formed at the same position as the notch with respect to the forward or rearward direction, as separated from the notch. The slitted plate fins can be formed by blanking with use of a die which is used for blanking out the other plate fins and which is removably provided with a notch forming portion and a slit forming portion. Thus, one type of blanking die is usable for forming two kinds of plate fins, which are therefore made available at reduced costs. Further since the slitted plate fins have a V-shaped notch in the midportion of at least one of upper and lower edges thereof in the forward or rearward direction, and a slit extending upward or downward and formed at the same position as the notch with respect to the forward or rearward direction, as separated from the notch can be-divided easily.

In the process of the invention for fabricating either one of the two heat exchangers, a straight tube portion having a predetermined number of second fin groups may be cut off from the finned hairpin tube after the second fin groups are formed by dividing the dividable fin group.

BEST MODE OF CARRYING OUT THE INVENTION

An embodiment of the invention will be described below with reference to the drawings. The embodiment is a heat exchanger to which the invention is applied and which is an evaporator for use in refrigeration devices. In the following description, the term "aluminum" includes aluminum alloys in addition to pure aluminum.

Figure 1:
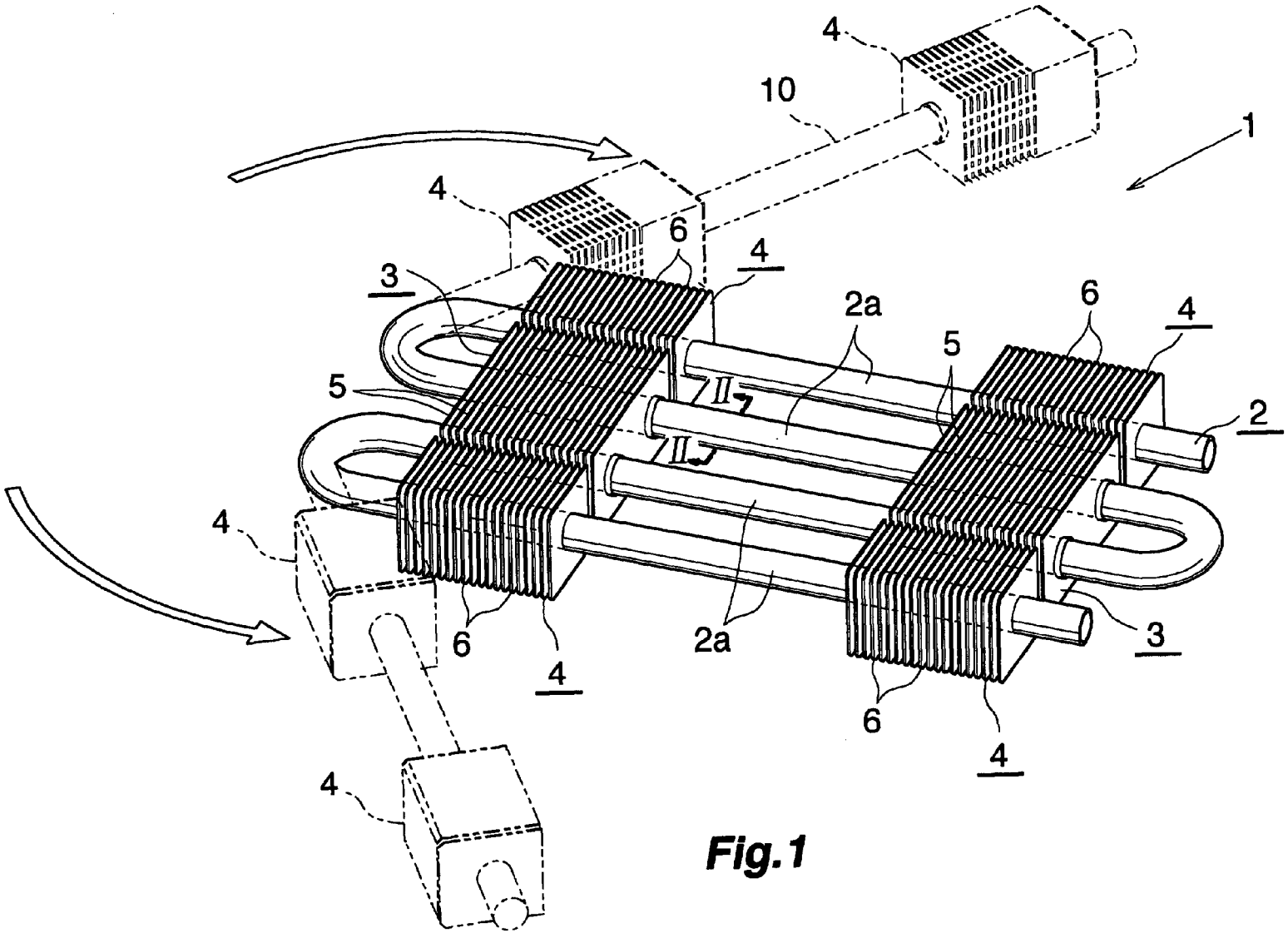
FIG. 1 is a perspective view showing a finned zigzag tube for fabricating an evaporator embodying the invention.

FIG. 1 shows a finned zigzag tube 1 which comprises a zigzag tube 2 of aluminum having at least three, i.e. in this case, four, straight tube portions 2*a* arranged from the front rearward at a spacing, a plurality of, i.e. in this case, two, first fin groups 3 arranged at a spacing on the two adjacent straight tube portions 2*a* in the center of the zigzag tube 2 longitudinally of the portions 2*a*, and a plurality of, i.e. in this case, two, second fin groups 4 arranged at a spacing on the respective straight tube portions 2*a* at the front and rear ends of the zigzag tube 2 longitudinally of the portions 2*a*. The spacing between the two first fin groups 3 and the spacing between the two second fin groups 4 are a length permitting the straight tube portions 2*a* to be so bent as to position the first fin groups 3 one above the other and the second fin groups 4 one above the other in superposed layers.

The zigzag tube 2 is formed by bending a pipe having no welded seams. The tube 2 is integrally provided with high and low two kinds of inner fins 20, 21 projecting from the inner peripheral surface of the tube to different heights, extending longitudinally thereof, and alternately arranged circumferentially thereof at a spacing. The inner fins 20, 21 project toward the center of the zigzag tube 2. The high inner fins 20 are 0.7 to 1.7 mm in height h1 as measured from the inner peripheral surface of the zigzag tube 2, and the low inner fins 21 are 0.4 to 1.2 mm in height h2 as measured from the surface of the zigzag tube 2. The pitch p of the inner fins 20, 21 is 0.4 to 1.6 mm. The pitch p of the inner fins 20, 21 is the circumferential distance, as measured in cross section on the outer periphery of the zigzag tube 2, between two straight lines connecting the center line of the zigzag tube 2 and the centers of the thicknesses of a pair of adjacent inner fins 20, 21. The zigzag tube 2 is 6 to 10 mm in outside diameter, and 0.4 to 0.8 mm in the thickness of the circumferential wall thereof.

The first fin group 3 comprises parallel aluminum plate fins 5 extending across and fixed to the two straight tube portions 2*a*. The plate fins 5 are rectangular and elongated in the forward or rearward direction. The plate fins 5 constituting the first fin group 3 will hereinafter be referred to as the "first plate fins. The second fin group 4 comprises aluminum plate fins 6 fixed to the corresponding straight tube portion 2*a* and is disposed in the same position as the first fin group 3 with respect to the longitudinal direction of the straight tube portion 2*a*. The front-to-rear length of the plate fins 6 of the second fin group 4 is equal to one half of the front-to-rear length of the first plate fins 5, or is shorter than one half thereof by an amount correspond to the notch 12 and slit 13 to be described later. The plate fins 6 constituting the second fin group 4 will hereinafter be referred to as the "second plate fins." The first fin group 3 and the second fin group 4 are not always the same in fin pitch; preferably, the second fin group 4 is greater than the first fin group 3 in fin pitch.

The first plate fins 5 each have two holes 5*a* spaced apart in the forward or rearward direction. The two straight tube portions 2*a* in the center of the zigzag tube 2 are inserted through the respective holes 5*a* of all the first plate fins 5, which are fixedly fitted around the two straight tube portions 2*a* by enlarging these tube portions 2*a*. The second plate fins 6 each have one hole, and the straight tube portion 2*a* at the front or rear end of the zigzag tube 2 is inserted through the holes of all the corresponding second plate fins 6, which are fixedly fitted around the straight tube portion 2*a* by enlarging the tube portion 2*a*. Incidentally, the finned zigzag tube 1 is also usable as it is as an evaporator.

Figure 3:
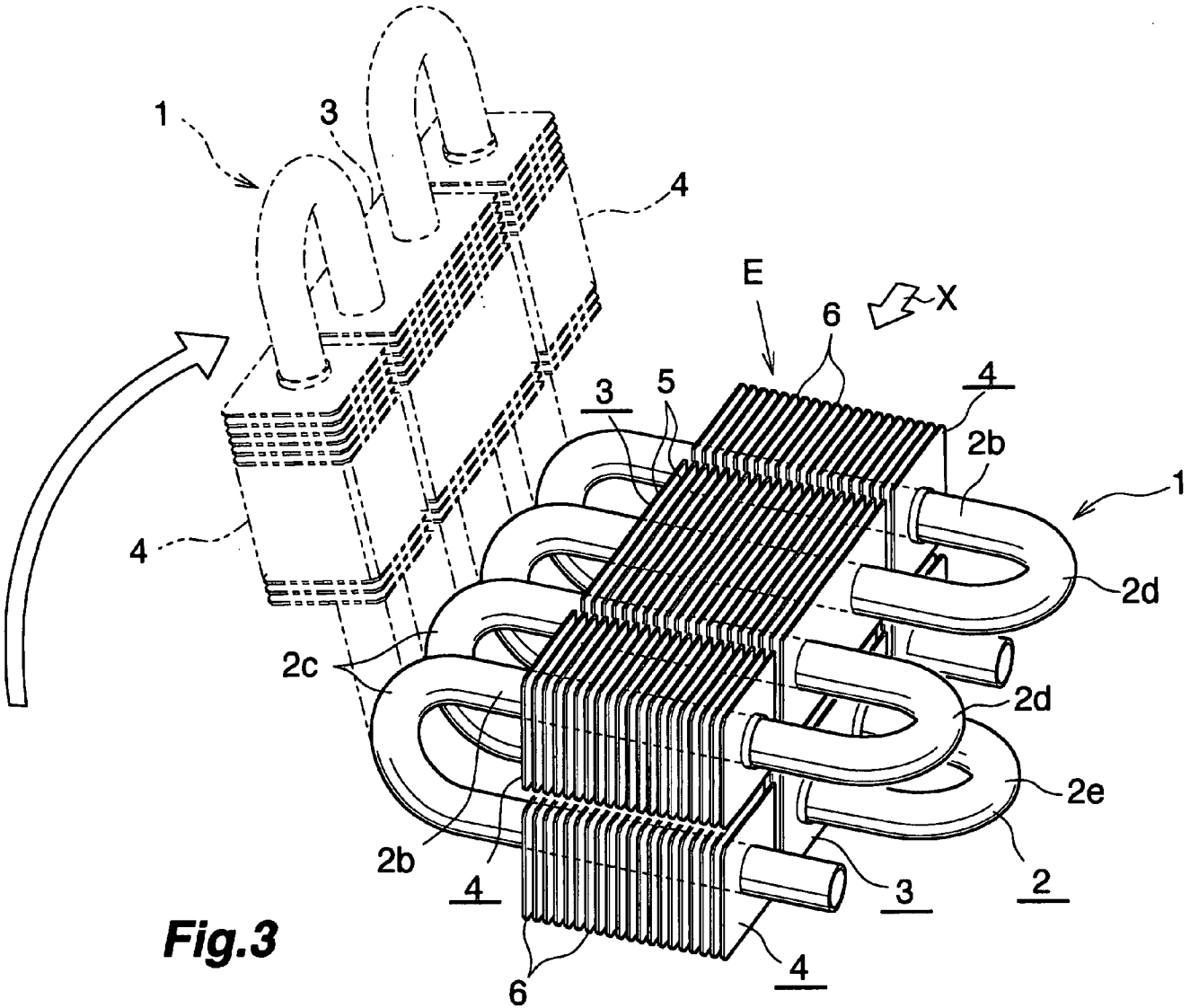
FIG. 3 is a perspective view showing the evaporator embodying the invention.

As shown in FIG. 3, the finned zigzag tube 1 is bent at a location between the adjacent first fin groups 3 and between the second fin groups 4 where all the straight tube portions 2*a* are adjacent to one another, so as to position the first fin groups 3 one above the other and the second fin groups 4 one above the other in superposed layers, whereby an evaporator E is fabricated. This evaporator E has two first fin groups 3 arranged one above the other in superposed layers, two second fin groups 4 arranged one above the other in superposed layers on each of front and rear sides of these first fin groups 3, front and rear two straight tube portions 2*b* extending through the first plate fins 5 of each first fin group 3, and one straight tube portion 2*b* extending through the second plate fins 6 of each second fin group 4. At the left of the fin groups 3, 4, the upper and lower straight tube portions 2*b* which are in the same position with respect to the forward or rearward direction are interconnected by a bent portion 2*c* integral with these tube portions 2*b*. Further at the right of the fin groups 3, 4, the two at each of the front and rear sides of the upper straight tube portions 2*b* are interconnected by a bent portion 2*d* integral with the two, and the central two of the lower straight tube portions 2*b* are interconnected by a bent portion 2*e* integral therewith.

The evaporator will be fabricated by the process to be described below.

Figure 4:
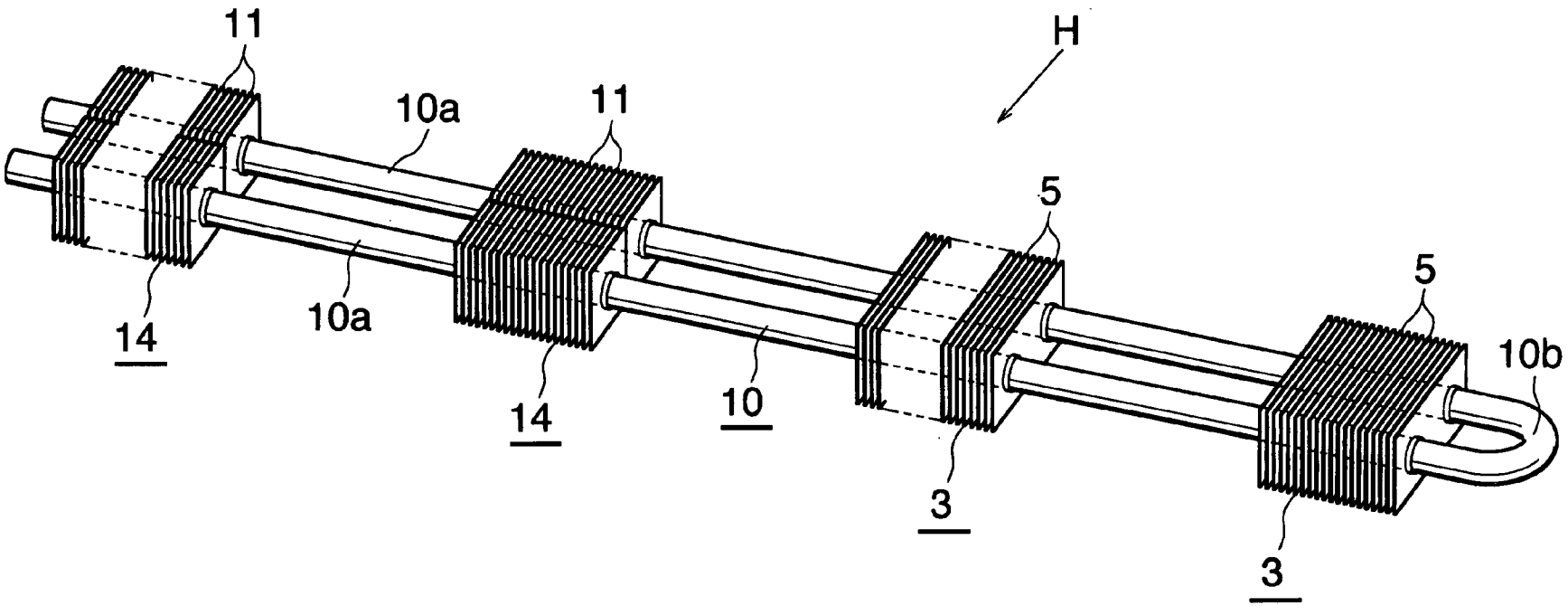
FIG. 4 is a perspective view showing a finned hairpin tube for making the finned zigzag tube.

First, a finned hairpin tube H shown in FIG. 4 is fabricated.

Figure 5:
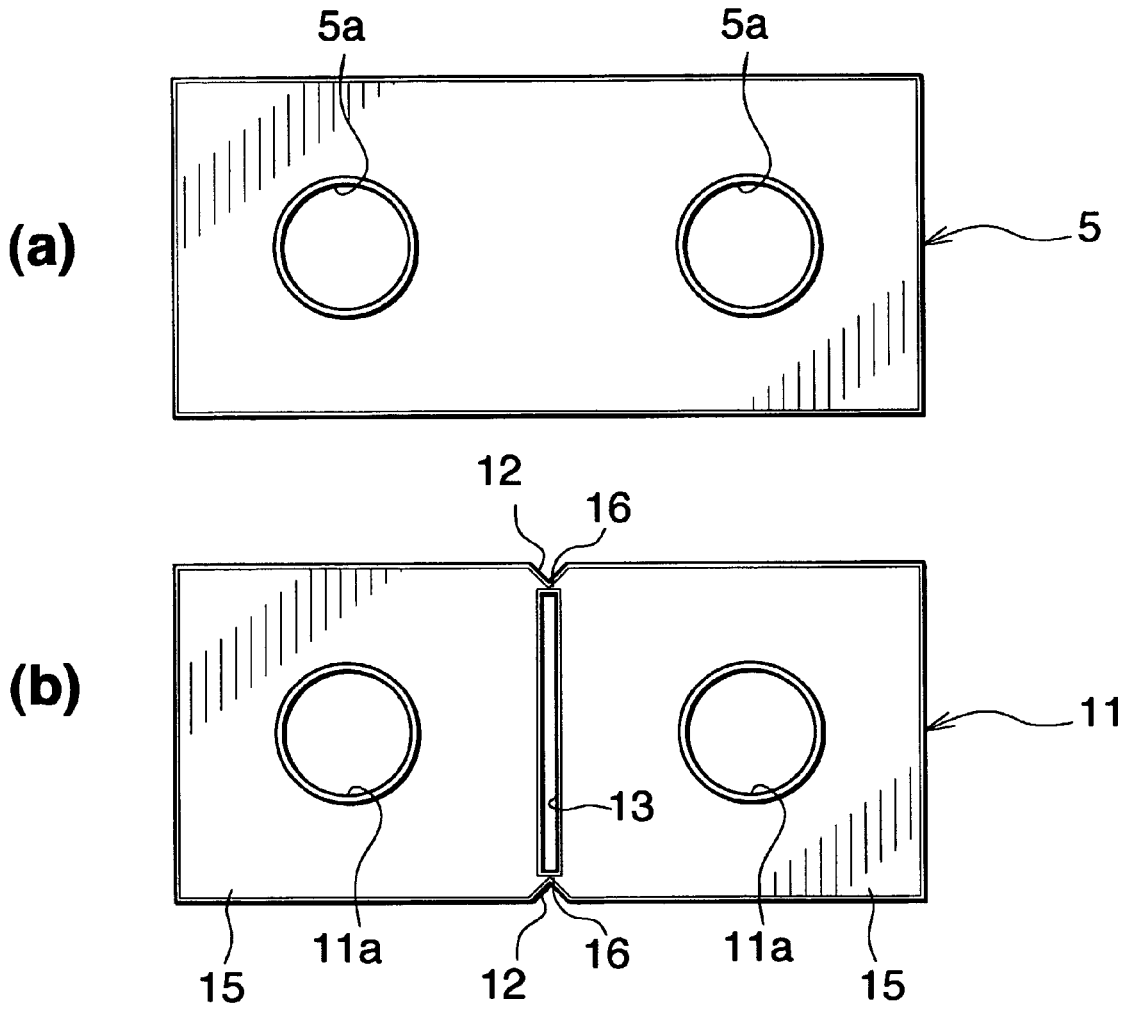
FIG. 5 includes front views showing two kinds of plate fins.

Prepared for this tube are a hairpin tube 10 formed by bending an aluminum pipe having no welded seams, a plurality of first plate fins 5 of aluminum each having two holes 5*a* spaced apart in the forward or rearward direction, and aluminum plate fins 11 each having two holes 11*a* spaced apart in the forward or rearward direction (see FIG. 5).

Figure 2:
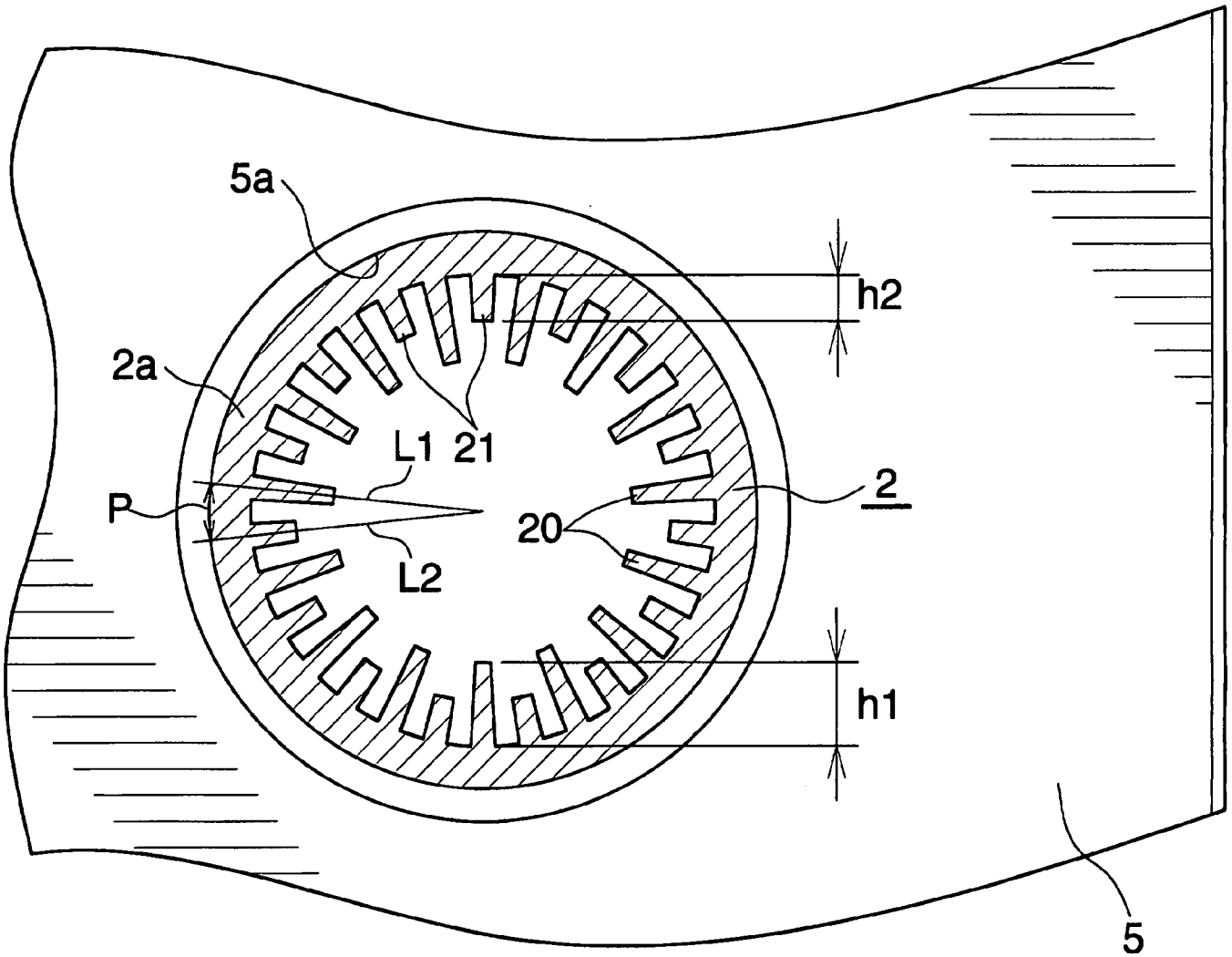
FIG. 2 is an enlarged view in section taken along the line II—II in FIG. 1.

The hairpin tube 10 is integrally provided with high and low two kinds of inner fins 20, 21 projecting from the inner peripheral surface of the tube to different heights, extending longitudinally thereof, and alternately arranged circumferentially thereof at a spacing. The inner fins 20, 21 are the same as those already described with reference to FIG. 2.

As shown in FIG. 5, the plate fins 5, 11 are rectangular and elongated in the forward or rearward direction. The plate fin 11 has a V-shaped notch 12 formed in the midportion of each of upper and lower edges thereof along the forward or rearward direction, and a slit 13 extending between the notches 12 widthwise (upward or downward) of the plate fin 11. The holes 11*a* are positioned respectively on the front and rear sides of the slit 13. The distance between each end of the slit 13 and the notch 12 is preferably about 0.1 to about 0.4 mm. The plate fin 11 having the notches 12 and the slit 13 will hereinafter be referred to as the "slitted plate fin." The slitted plate fin 11 is formed by blanking with a die which is used for blanking out the first plate fin 5 and which has notch forming portions and a slit forming portion removably attached thereto. With the notches 12 and the slit 13 formed, the slitted plate fin 11 comprises front and rear two fin forming portions 15 and connecting portions 16 each positioned between the notch 12 and the slit 13 and joining the two fin forming portions 15 dividably.

The two straight tube portions 10*a* of the hairpin tube 10 are then inserted through the respective holes 5*a*, 11*a* of all plate fins 5, 11 to thereby provide a plurality of, i.e. in this case, four, unfixed fin groups arranged on the straight tube portions 2*a* at a spacing longitudinally thereof and each comprising plate fins 5 or 11. The two unfixed fin groups toward the bent portion 10*b* of the hairpin tube 10 each comprise first plate fins 5 and provide the first fin groups 3 of the finned zigzag tube 1. The two unfixed fin groups toward the two end openings of the hairpin tube 20 each comprise slitted plate fins 11 and provide the second fin groups 4 of the finned zigzag tube 1. The spacing between the unfixed fin groups providing the first fin groups 3 is a length permitting the two straight tubes 10*a* to be so bent as to position the first fin groups 3 one above the other in superposed layers, and is equal to the spacing between the unfixed fin groups providing the second fin groups 4. The total number of unfixed fin groups is n (which is an integer of not smaller than 2) times the number of unfixed fin groups providing the first fin groups 4.

A pressure fluid such as water, oil or air is then introduced into the hairpin tube 10 in this state to enlarge the tube to fixedly fit the first plate fins 5 and the slitted plate fins 11 of the unfixed fin groups around the two straight tube portions 10*a* of the hairpin tube 10 and to thereby fabricate a finned hairpin tube H which has two dividable fin groups 14 providing the second fin groups 4, and two first fin groups 3 (see FIG. 4). The hairpin tube 10 may be enlarged alternatively by preparing a tube enlarging device comprising a pressure rod and a tube enlarging mandrel attached to the forward end of the rod and forcing the mandrel of the device into the straight tube portions 2*a* from end openings of the hairpin tube 10.

The finned hairpin tube H is thereafter made into a finned zigzag tube 1. First, the slitted plate fins 11 constituting the two dividable fin groups 14 of the hairpin tube 10 are divided at the connecting portions 16 between the slit 13 and the notches 12 into portions fixed to one of the straight tube portions 10*a* and the portions fixed to the other straight tube portion 10*a* to form second fin groups 4. Each slitted plate fin 11 is divided by pulling the fin 11 apart forward and rearward, with a wedge pressed against the two notches 12. Subsequently, the two straight tube portions 10*a* of hairpin tube 10 of the finned hairpin tube H are bent outward between the first fin group 3, i.e., the second as counted from the bent portion of the tube 10, and the second fin group 4, i.e., the third as counted from the bent portion, forwardly and rearwardly respectively (see chain lines in FIG. 1). In this way, a finned zigzag tube 1 is fabricated which comprises a plurality of first fin groups 3 arranged at a spacing on the two adjacent straight tube portions 2*a* in the center of the zigzag tube 2 longitudinally of the portions 2*a*, and a plurality of second fin groups 4 arranged at a spacing on the respective straight tube portions 2*a* at the front and rear ends of the zigzag tube 2 longitudinally of the portions 2*a*.

Finally, the finned zigzag tube 1 is bent at a location between the adjacent first fin groups 3 and between the second fin groups 4 where all the straight tube portions 2*a* are arranged, so as to position the first fin groups 3 one above the other and the second fin groups 4 one above the other in superposed layers, whereby an evaporator E is fabricated (see chain lines in FIG. 3).

The evaporator E has a refrigeration cycle having a compressor, a condenser and an evaporator, and is used as an evaporator in refrigeration devices, such as refrigerators or refrigerated showcases, wherein a hydrocarbon refrigerant is used as the refrigerant and circulated at a rate as low as 1 to 9 kg/h.

With the foregoing embodiment, the zigzag tube 2 constituting the finned zigzag tube 1 for making the evaporator E has straight tube portions 2*a* which are 4 in number, and the dividable fin groups 14 comprising slitted plate fins 11 and included in the finned hairpin tube H are therefore equal to the first fin groups 3 in number. However, the number of straight tube portions 2*a* is not limitative but can be any number represented by 2*n* (wherein n is an integer of not smaller than 2). In this case, the number of dividable fin groups 14 comprising slitted plate fins 11 and included in the finned hairpin tube H is made equal to (n−1) times the number of first fin groups 3. A finned zigzag tube is then formed by bending zigzag the two straight tube portions 10*a* of hairpin tube 10 of the finned hairpin tube H forwardly and rearwardly outward. Although there arises a case wherein the number of straight tube portions 2*a* of zigzag tube 2 constituting the finned zigzag tube 1 is an odd number of at least 3, i.e., 2n−1 (wherein n is an integer of not smaller than 2), this case can then be handled by dividing the slitted plate fins 11 of the dividable fin groups 14 and cutting off one of the straight tube portions 10*a* of the hairpin tube 10 over a length from the end opening thereof which length has second fin groups 4 which are equal in number to the number of first fin groups 3.

According to the embodiment described above, the first fin groups 3 and the second fin groups 4 of the evaporator are arranged in two superposed layers, whereas this arrangement is not limitative but these fin groups may be arranged in at least three superposed layers. The finned zigzag tube 1 are then at least three in the number of first fin groups 3, as well as of second fin groups 4. The first fin groups 3 and second fin groups 4 may be provided in only one layer. In this case, the fin groups 3 and 4 may each be only one in number.

Further according to the foregoing and other embodiments, the plate fins to be divided need not always have the slit 13 or notch 12.

The heat exchanger of the invention is usable also as means other than the evaporator of the refrigerant device.

Figure 6:
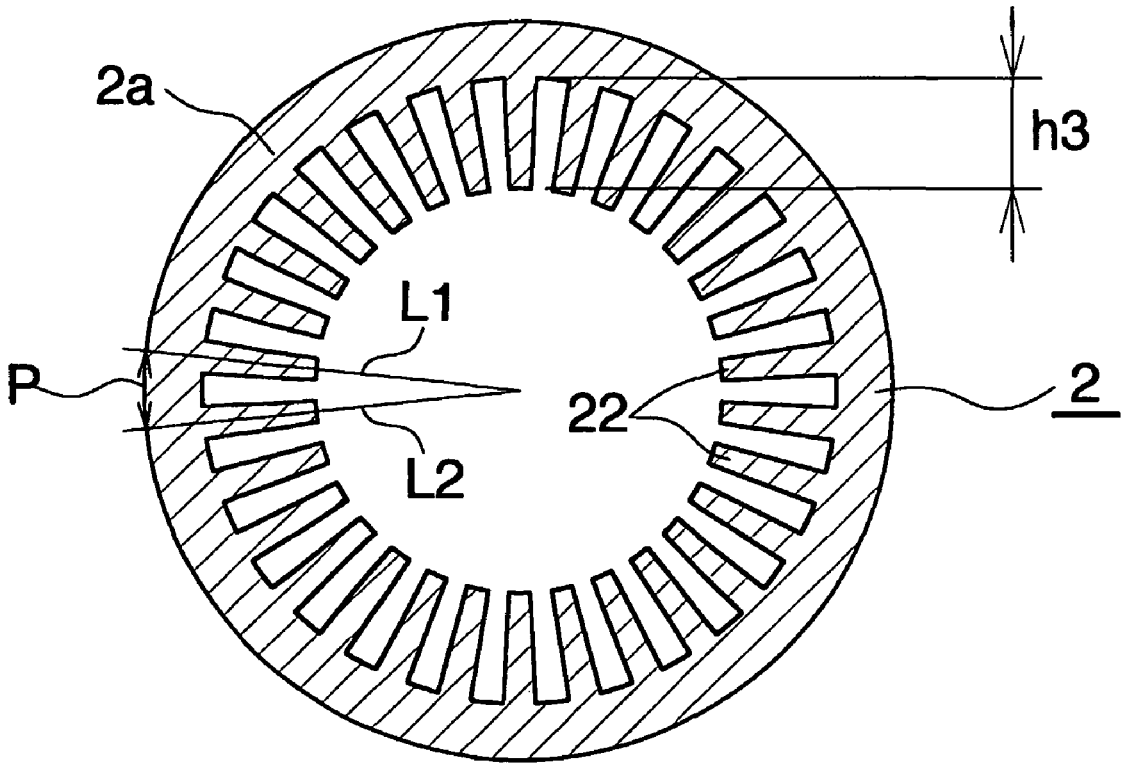
FIG. 6 is a sectional view corresponding to FIG. 2 and showing another example of finned zigzag tube.
Figure 7:
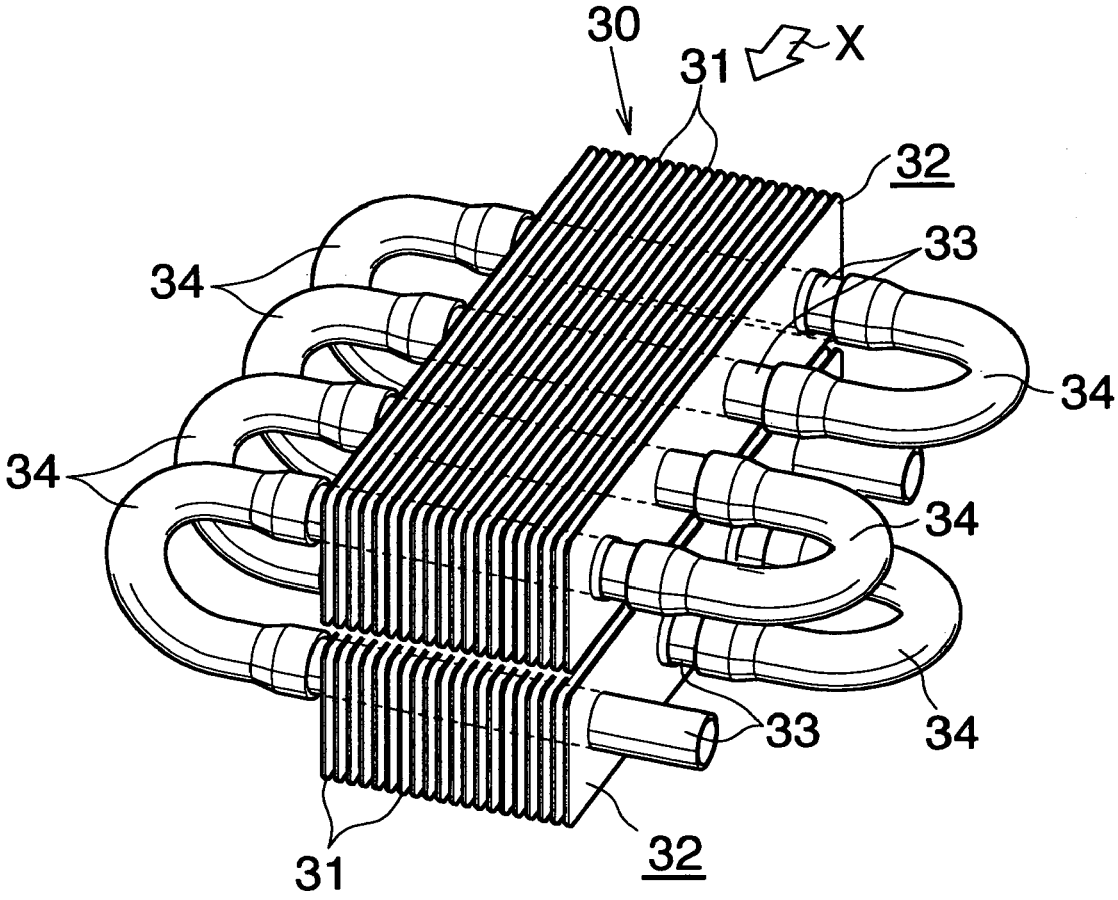
Fig.7 PRIOR ART
FIG. 7 is a perspective view showing a conventional evaporator.

FIG. 6 shows a modification of zigzag tube 2 constituting a finned zigzag tube 1 for use in fabricating evaporators.

With reference to FIG. 6, the illustrated zigzag tube 2 is integrally provided with a plurality of inner fins 22 projecting from the inner peripheral surface of the tube to equal heights, extending longitudinally thereof, and arranged circumferentially thereof at a spacing. The inner fins 22 are 0.7 to 1.2 mm in height h3 as measured from the inner peripheral surface of the zigzag tube 2. The inner fins 22 are 0.4 to 1.6 mm in pitch p. The term "pitch p" of the inner fins 22 has the same meaning as already described. The zigzag tube 2 is 6 to 10 mm in outside diameter, and 0.4 to 0.8 mm in the thickness of the circumferential wall thereof.

INDUSTRIAL APPLICABILITY

The heat exchanger of the present invention is useful as an evaporator for refrigeration devices, such as refrigerators or refrigerated showcases, and is especially suitable for use as an evaporator in refrigeration devices wherein a hydrocarbon refrigerant is used.

The invention claimed is:

1. A process for fabricating a heat exchanger, comprising:

preparing a hairpin tube by bending a pipe having no welded seams and a plurality of plate fins each having two holes spaced apart;

inserting two straight tube portions of the hairpin tube through the respective holes of the plate fins to thereby arrange the plate fins in parallel into a predetermined number of unfixed fin groups spaced apart on the straight tube portions longitudinally thereof by a length permitting bending of the straight tube portions;

enlarging the hairpin tube to fixedly position the plate fins across the two straight tube portions to obtain a finned hairpin tube having a dividable fin group for forming second fin groups and a first fin group;

dividing the plate fins of the dividable fin group into portions fixed to one of the straight tube portions and portions fixed to the other straight tube portion to form the second fin groups; and outwardly bending the two straight tube portions of the finned hairpin tube forward and rearward respectively, wherein the plate fins of the dividable fin group for forming the second fin groups each comprise two fin forming portions and connecting portions dividably joining the two fin forming portions.

2. A process for fabricating a heat exchanger according to claim 1 wherein the hairpin tube is integrally provided on an inner peripheral surface thereof with inner fins extending longitudinally thereof and arranged at a spacing circumferentially thereof.

3. A process for fabricating a heat exchanger according to claim 2 wherein the hairpin tube has high and low two kinds of inner fins alternately arranged circumferentially thereof and projecting from the inner peripheral surface of the tube to different heights, the high inner fins being 0.7 to 1.7 mm in height from the tube surface, the low inner fins being 0.4 to 1.2 mm in height from the surface.

4. A process for fabricating a heat exchanger according to claim 3 wherein the pitch of the inner fins is 0.4 to 1.6 mm.

5. A process for fabricating a heat exchanger according to claim 3 wherein the hairpin tube is 6 to 10 mm in outside diameter and 0.4 to 0.8 mm in the wall thickness of a circumferential wall thereof.

6. A process for fabricating a heat exchanger according to claim 2 wherein all the inner fins are equal in height and are 0.7 to 1.2 mm in height from the inner peripheral surface of the hairpin tube.

7. A process for fabricating a heat exchanger according to claim 6 wherein the pitch of the inner fins is 0.4 to 1.6 mm.

8. A process for fabricating a heat exchanger according to claim 6 wherein the hairpin tube is 6 to 10 mm in outside diameter and 0.4 to 0.8 mm in the wall thickness of a circumferential wall thereof.

9. A process for fabricating a heat exchanger according to claim 1 wherein the hairpin tube is enlarged with use of a fluid.

10. A process for fabricating a heat exchanger according to claim 1 wherein a straight tube portion having a predetermined number of second fin groups is cut off from the finned hairpin tube after the second fin groups are formed by dividing the dividable fin group.

11. A process for fabricating a heat exchanger, comprising:

preparing a hairpin tube by bending a pipe having no welded seams and a plurality of plate fins each having two holes spaced apart;

inserting two straight tube portions of the hairpin tube through the respective holes of the plate fins to thereby arrange the plate fins in parallel into a predetermined number of unfixed fin groups spaced apart on the straight tube portions longitudinally thereof by a length permitting bending of the straight tube portions;

enlarging the hairpin tube to fixedly position the plate fins across the two straight tube portions to obtain a finned hairpin tube having a dividable fin group for forming second fin groups and a first fin group;

dividing the plate fins of the dividable fin group into portions fixed to one of the straight tube portions and portions fixed to the other straight tube portion to form the second fin groups; and outwardly bending the two straight tube portions of the finned hairpin tube forward and rearward respectively, wherein the plate fins of the first fin group and the plate fins of the dividable fin group for forming the second fin groups are identical in shape, and the plate fins of the dividable fin group each have a V-shaped notch formed in a midportion of at least one of upper and lower edges thereof in the forward or rearward direction, and a slit extending upward or downward and formed at the same position as the notch with respect to the forward or rearward direction, as separated from the notch.

12. A process for fabricating a heat exchanger according to claim 11 wherein the hairpin tube is integrally provided on an inner peripheral surface thereof with inner fins extending longitudinally thereof and arranged at a spacing circumferentially thereof.

13. A process for fabricating a heat exchanger according to claim 12 wherein the hairpin tube is enlarged with use of a fluid.

14. A process for fabricating a heat exchanger according to claim 12 wherein the hairpin tube has high and low two kinds of inner fins alternately arranged circumferentially thereof and projecting from the inner peripheral surface of the tube to different heights, the high inner fins being 0.7 to 1.7 mm in height from the tube surface, the low inner fins being 0.4 to 1.2 mm in height from the surface.

15. A process for fabricating a heat exchanger according to claim 14 wherein the pitch of the inner fins is 0.4 to 1.6 mm.

16. A process for fabricating a heat exchanger according to claim 14 wherein the hairpin tube is 6 to 10 mm in outside diameter and 0.4 to 0.8 mm in the wall thickness of a circumferential wall thereof.

17. A process for fabricating a heat exchanger according to claim 12 wherein all the inner fins are equal in height and are 0.7 to 1.2 mm in height from the inner peripheral surface of the hairpin tube.

18. A process for fabricating a heat exchanger according to claim 17 wherein the pitch of the inner fins is 0.4 to 1.6 mm.

19. A process for fabricating a heat exchanger according to claim 17 wherein the hairpin tube is 6 to 10 mm in outside diameter and 0.4 to 0.8 mm in the wall thickness of a circumferential wall thereof.

20. A process for fabricating a heat exchanger according to claim 11 wherein a straight tube portion having a predetermined number of second fin groups is cut off from the finned hairpin tube after the second fin groups are formed by dividing the dividable fin group.

* * * * *